United States Patent [19]

McMullen, Jr.

[11] Patent Number: 4,819,673

[45] Date of Patent: Apr. 11, 1989

[54] NAIL CLIPPER

[76] Inventor: Thomas J. McMullen, Jr., 9270 Overlook Trail, Eden Prairie, Minn. 55344

[21] Appl. No.: 33,342

[22] Filed: Apr. 1, 1987

[51] Int. Cl.[4] ..... A45D 29/02

[52] U.S. Cl. ..... 132/75.5; 30/28

[58] Field of Search ..... 30/28, 29, 125, 194; 132/75.5, 75.4

[56] References Cited

U.S. PATENT DOCUMENTS

| | | | |
|---|---|---|---|
| 2,616,436 | 11/1952 | Langley | 30/29 |
| 2,753,626 | 7/1956 | Bowers | 30/28 |
| 2,799,923 | 7/1957 | Senshu | 30/28 |
| 2,887,773 | 5/1959 | Killen | 30/28 |
| 2,970,376 | 2/1961 | Kuo | 30/28 |
| 2,986,257 | 10/1961 | Kiura | 30/28 |
| 2,999,506 | 9/1961 | Hunt | 30/29 |
| 3,013,334 | 12/1961 | Bassett | 30/28 |
| 3,031,753 | 5/1962 | Pocoski | 30/28 |
| 3,042,047 | 7/1962 | Plaskon | 132/75.5 |
| 3,169,312 | 2/1965 | Fink | 30/28 |
| 3,188,737 | 6/1965 | Chase | 30/124 |
| 3,189,996 | 6/1965 | Casey, Jr. | 30/28 |
| 3,315,354 | 4/1967 | Oates, Jr. | 30/28 |
| 3,744,131 | 7/1973 | Manes | 30/28 |
| 4,130,937 | 12/1978 | Kim | 30/28 |
| 4,614,031 | 9/1986 | Chen | 132/75.5 |
| 4,648,415 | 3/1987 | Yuan | 30/28 |

FOREIGN PATENT DOCUMENTS

| | | | |
|---|---|---|---|
| 243901 | 12/1925 | United Kingdom | 132/75.5 |

*Primary Examiner*—Gene Mancene
*Assistant Examiner*—Cary E. Stone
*Attorney, Agent, or Firm*—Merchant, Gould, Smith, Edell, Welter & Schmidt

[57] ABSTRACT

A nail clipper (10) is disclosed which includes a one-piece, U-shaped, plastic body having a pair of longitudinal handles (13, 14) with blades (11, 12) on one or both of the longitudinal handles of the device. An integral central arc portion (15) bends when the longitudinal handles (13, 14) are compressed. The blades (11, 12) are aligned to provide a scissors-like interference cut. A receptacle (18) for the nail clippings may also be provided, either between the two handles (13, 14), within the lower handle (14) itself, or directly beneath the lower blade (12). The receptacle may be provided with a pivoting or removable cover (19). A file surface (21) may also be affixed to the nail clipper.

45 Claims, 4 Drawing Sheets

NAIL CLIPPER

FIELD OF THE INVENTION

The present invention relates to nail clippers and the like.

BACKGROUND OF THE INVENTION

Conventional nail clippers are typically made of metal and have a rather complicated construction. Usually, a lever is required to press the blades of the nail clipper together, and this lever must be swiveled through a 180° angle in order to place the nail clipper into an operating position. This operation is inconvenient and clumsy. Also, because of the many different parts required, the conventional nail clipper often requires complicated manufacturing techniques.

In addition, the user may easily cut himself with conventional nail clippers. If the fingernail is inserted too far into the nail clipper, cutting of the skin can easily result. Also, the conventional nail clippers typically do not provide any means to collect the nail clippings. If a receptacle is provided, it is often difficult to remove the nail fragments. Further, the conventional metal nail clipper has an unaesthetic appearance.

Finally, the conventional nail clipper is often difficult to use for people with arthritis or other hand-related problems. A substantial force, as well as dexterity and coordination, are often required in order to compress the blades so that the nails can be clipped, which can be difficult and painful for people with arthritis or other hand-related problems.

SUMMARY OF THE INVENTION

The present invention addresses many of the above difficulties in the conventional nail clippers. The invention embodies a novel construction of a nail clipper which is preferably U-shaped. The clipper body is made of a single piece, and it bends at a central arc portion when the pair of handles are compressed. The clipper is made of a plastic material which exhibits good memory or fatigue resistance, i.e., it returns to its original position after flexing. The plastic material maintains its strength and stability because of the limited range of movement necessary to cut the nail.

It is an object of the invention to provide an uncomplicated nail clipper body which is a single integral piece and easy to manufacture. As a result, the nail clipper of the present invention is compact and attractive.

It is a further object of the invention to provide a nail clipper device containing a safety feature which prevents the user from being cut while clipping his nails. This safety feature lies partially in the alignment of the blades to produce a scissors-like interference cut and the fact that the nail clipper's blades are spaced relatively close together. In addition, the bottom blade acts as a stop against the end of the user's finger to prevent insertion of the finger between the blades.

It is a still further object of the invention to provide a nail clipper with a receptacle, which will permit the user to cut his/her nails and simultaneously cause the nail clippings to drop unhindered into a receptacle for retention therewithin. Several different embodiments of receptacles are disclosed, both with and without receptacle closures.

For example, the receptacle may comprise a cavity within one of the two handles with a pivoting cover on the opposite end of the cavity. Alternatively, the receptacle can be positioned between the upper and lower handles, with the sides of the receptacle being integral with and between the inner surfaces of the handles. In order to empty the clippings from this receptacle, one embodiment of the invention provides for the displacement of a pivotable cover. Another embodiment provides for the pulling apart of the handles, and yet another embodiment provides for an uncovered opening within one of the handles from which the clippings can be emptied. Alternatively, a receptacle may be provided beneath the lower blade.

It is still another object of the invention to provide lengthened handles which result in increased leverage for people with arthritis and other hand-related problems. This construction enables such persons to easily clip their nails with minimal effort.

It is another object to provide an ambidextrous nail clipper having blades on both sides of the device. This enables the user to clip both his right and left hand with equal facility.

It is a further object of this invention to provide a rigid attachment of the blades to the handles by a unique process of pressing a roughened end of the blades into the plastic material of the handles.

The single device of the present invention can also provide a complete manicure by providing a file surface affixed to the nail clipper.

These and other objects of the invention will become apparent from a consideration of the following specification and accompanying drawings which form a part of this application.

In carrying out the objects of the invention, it is to be understood that its essential features are susceptible of change in design and structural arrangement, with only one preferred and practical embodiment being illustrated in the accompanying drawings, as required.

BRIEF DESCRIPTION OF THE DRAWINGS

In the accompanying drawings, wherein like numerals of reference refer to similar parts throughout.

DESCRIPTION OF THE PREFERRED EMBODIMENT

Figure 1:
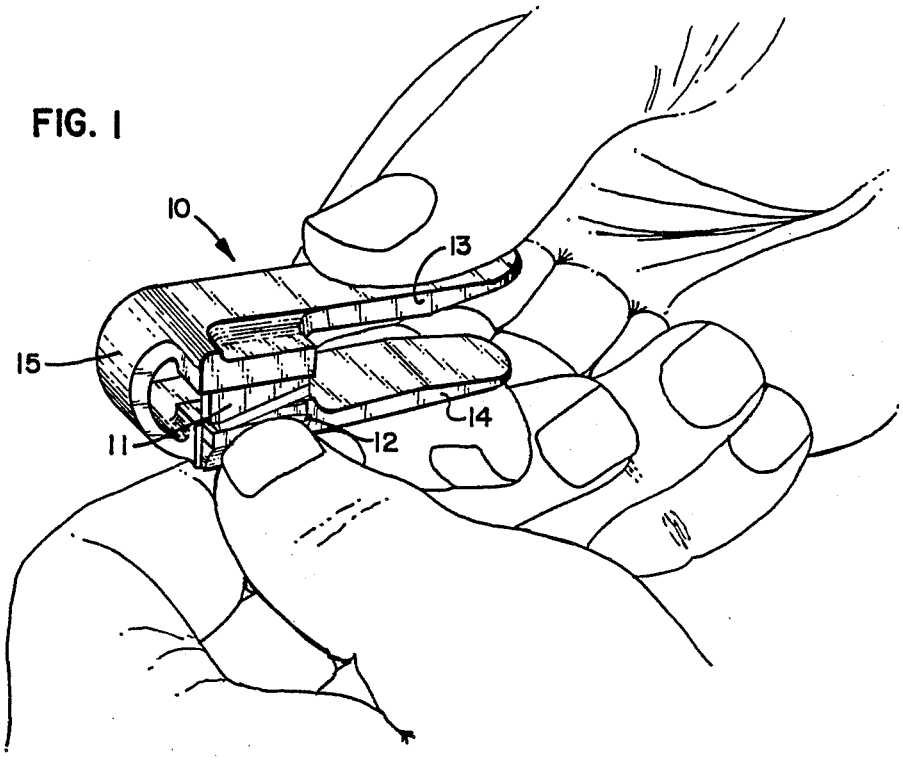
FIG. 1 is a perspective view of the nail clipper of the present invention in use.
Figure 2:
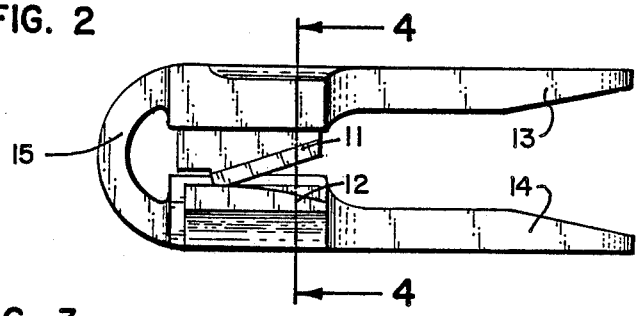
FIG. 2 is a side elevational view of the preferred embodiment of the nail clipper in its open position.

The preferred embodiment of the present invention is illustrated in FIGS. 1–4. The U-shaped nail clipper 10 has an upper blade 11 and a lower blade 12 which are aligned to produce a scissors-type interference cut. That is, the blades 11 and 12 are not aligned to meet at their respective edges, but rather they interface with each other in a flush manner so as to shear off the fingernail. As shown in FIG. 1, the upper 11 and lower 12 blades are positioned close enough together so that it is difficult if not nearly impossible for the user to cut himself while trimming his nails, because there is not enough space to insert anything but the nail itself. Both the positioning of the upper 11 and lower 12 blades, and the scissors-type interference cut, contribute toward this safety feature.

Figure 3:
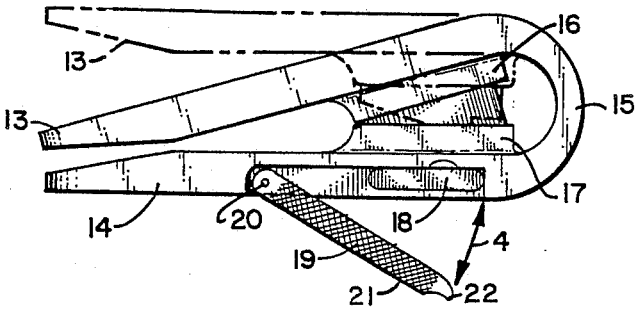
FIG. 3 is a side elevational view of the opposite side of the device shown in FIG. 2 in its closed position, with the open position shown in phantom.

The nail clipper 10 also includes an upper 13 and lower 14 handle which are compressed by the user when a cutting action is desired as shown in FIG. 1. These handles 13 and 14 are connected by an integral central arc portion 15 which bends as the handles 13 and 14 are compressed. Preferably, the handles 13, 14 are approximately two and one-fourth (2¼) inches in length. The handles 13 and 14 and arc portion 15 are preferably made of a suitable plastic material which exhibits good memory and which is well-suited to injection molding. As best shown in FIG. 3, the nail clipper 10 is also provided with a pair of upper 16 and lower 17 stops positioned within the handles 13 and 14 to limit the range of movement of the nail clipper when compressed. These stops 16 and 17 are preferably formed integrally with the handles 13 and 14 from the same plastic material.

Also provided is a receptacle 18 within the lower handle 14 of the nail clipper 10. The receptacle 18 is a transverse cavity which runs across the lower handle 14. One opening of the receptacle 18 is located proximate the bottom blade, with a second opening being located on the opposite side of the handle 14. When it is desired to empty the receptacle 18 of the nail clippings, the user simply pivots a cover 19 away from the second opening and tilts the nail clipper 10. The cover 19 is mounted onto the lower handle 14 by means of a pin 20. In addition, the cover 19 can be provided with a file surface 21 and a point 22 to facilitate filing and cleaning of the nails for a complete manicure.

Figure 4:
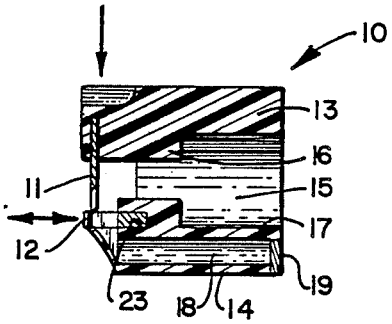
FIG. 4 is a transverse cross-sectional elevational view of the device shown in FIGS. 2 and 3 taken along line 4—4 of FIG. 2.
Figure 5:
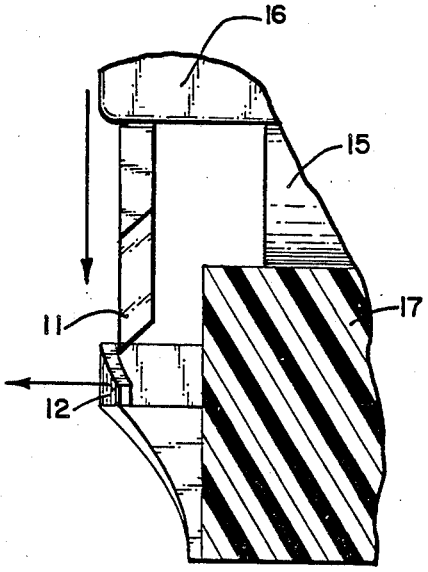
FIG. 5 is an enlarged partial cross-sectional view of the blades shown in FIG. 4 in the nail clipper's open position.
Figure 6:
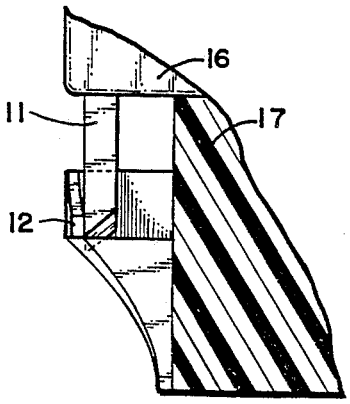
FIG. 6 is an enlarged partial cross-sectional view of the blades shown in FIG. 5 with the nail clipper in its closed position.

When the handles 13 and 14 are compressed, the upper blade 11 moves downward as illustrated by the vertical arrows in FIGS. 4 and 5. As the upper 11 and lower 12 blades move against each other, the scissors-type interference causes the lower blade 12 to flex slightly outward, as illustrated by the horizontal arrows in FIGS. 4 and 5. There is continuous contact between the upper 11 and lower 12 blade, which helps prevent the user from injuring himself. The downward movement of the upper blade 11 is limited by the upper 16 and lower 17 stops. The position of the stops 16 and 17 enables the cutting operation to be completed with a limited range of movement, which allows the plastic material of the nail clipper 10 to maintain its strength and stability. When the blades 11 and 12 are in their closed position, as is shown in FIG. 6, the lower blade 12 has flexed to its most outward position.

Figure 7:
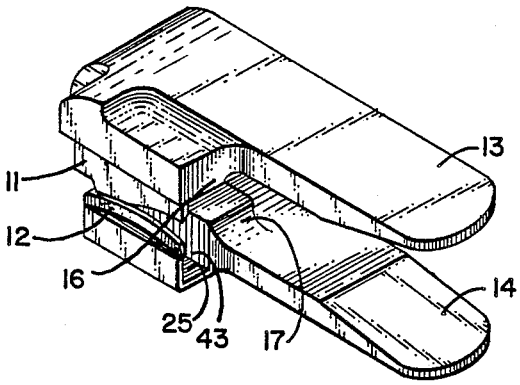
FIG. 7 is a perspective view of a first alternate embodiment of the present invention having a receptacle proximate the bottom blade.

A different type of receptacle is illustrated in the alternate embodiment of FIG. 7. The receptacle 25 is located proximate the bottom blade 12 so that the nail clippings fall within the receptacle 25. The receptacle 25 may be rectangular or any other suitable shape. The receptacle 25 is emptied by tilting the nail clipper 10 so that the clippings fall through the opening 43 on the end of the receptacle 25. Another feature illustrated in FIG. 7 is the concave curvature of the upper 11 and lower 12 blades. The scissors-type interference cut is also produced when the blades 11, 12 are concave. This curvature provides for a more uniform, aesthetic manicure.

Figure 8:
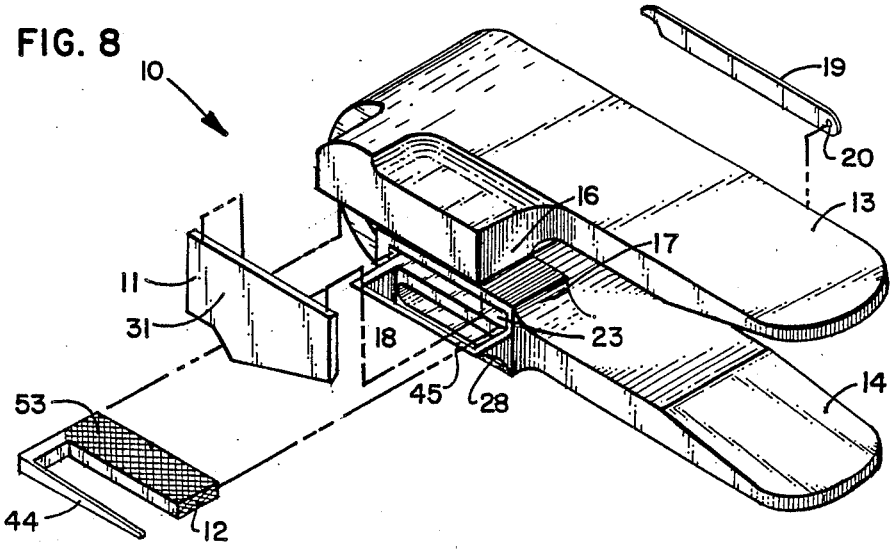
FIG. 8 is an exploded diagrammatic view of the nail clipper shown in FIGS. 2–4, the preferred embodiment of the present invention.

The construction of the nail clipper 10 is illustrated in FIGS. 4 and 8. A fillet 28 is provided to direct the nail clippings into the transverse receptacle 18 in the lower handle 14. The fillet 28 is preferably formed integrally with the nail clipper body 10, and is made of the same plastic material. The lower blade 12 preferably has a roughened end 53 which is pressed into a cavity 23 in the plastic material of the lower handle 14 proximate the lower stop 17. The roughened surface of the end 53 provides for a secure, rigid attachment of the lower blade 12 to the lower handle 14. The bottom edge 44 of the lower blade 12 can also be affixed to the top edge 45 of the fillet 28 with adhesive for a secure connection. The lower blade 12 and roughened end 53 are preferably made of metal.

Similarly, an upper portion 31 of the upper blade 11 is press-fit and embedded into a cavity (not shown) in the upper handle 13 proximate the upper stop 16. The upper blade 11 is preferably made of metal. A roughened surface (not shown) can be provided on the upper portion 31 of the blade 11 to facilitate adhesion to the plastic material of the upper handle 13. A secure and rigid connection is thereby provided between the upper blade 11 and the upper handle 13. The blades 11 and 12 could alternatively be made of a type of plastic suitable for clipping nails.

Figure 9:
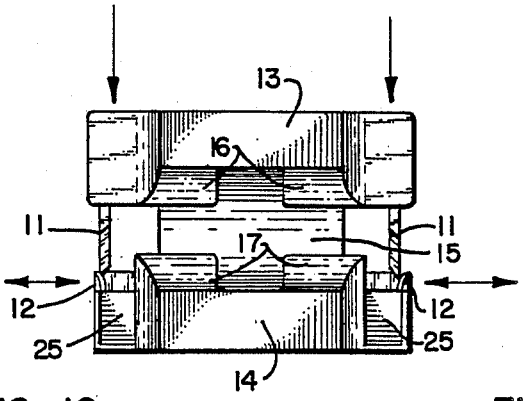
FIG. 9 is a transverse elevational view of a second alternate embodiment of the present invention having dual-sided blades.

FIG. 9 illustrates the second alternate embodiment of the nail clipper of the present invention with blades 11 and 12 provided on each longitudinal edge of the handles 13 and 14 for ambidextrous use. The embodiment illustrated in FIG. 9 has two pairs of stops 16 and 17, with stops being located on the inside of both the upper and lower handles 13, 14. There are two receptacles 25 provided, one proximate each bottom blade 12, similar to the receptacle 25 shown in FIG. 7.

Figure 10:
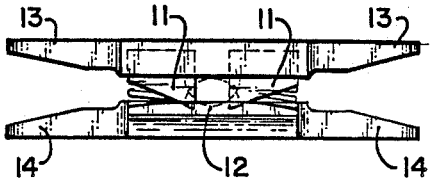
FIG. 10 is a side elevational view of a third alternate embodiment of the present invention having a "teeter-totter" configuration.
Figure 11:
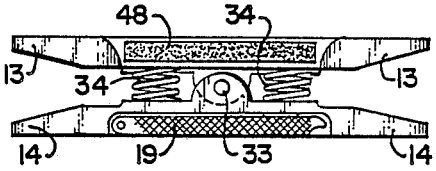
FIG. 11 is a side elevational view of the opposite side of the device shown in FIG. 10.

A third alternate embodiment of the present invention with a "teeter-totter" configuration is shown in FIGS. 10 and 11. In this embodiment there are two parallel horizontal handles 13, 14. Each parallel handle has two upper blades 11 and two corresponding lower blades 12. The handles 13 and 14 are interconnected by means of a central pin 33 and by a coil spring 34 on each side of the pin 33. There is a pair of blades 11, 12 on each side of the central pin 33. The springs 34 maintain the handles 13 and 14 in a substantially parallel position when they are not being compressed. Also provided is a pivotal file 19, and a second file surface 48 affixed to the upper handle 13. When this teeter-totter embodiment is used, the nail is inserted between one pair of the blades 11, 12 and the two parallel handles 13 and 14 are compressed on the appropriate end.

Figure 12:
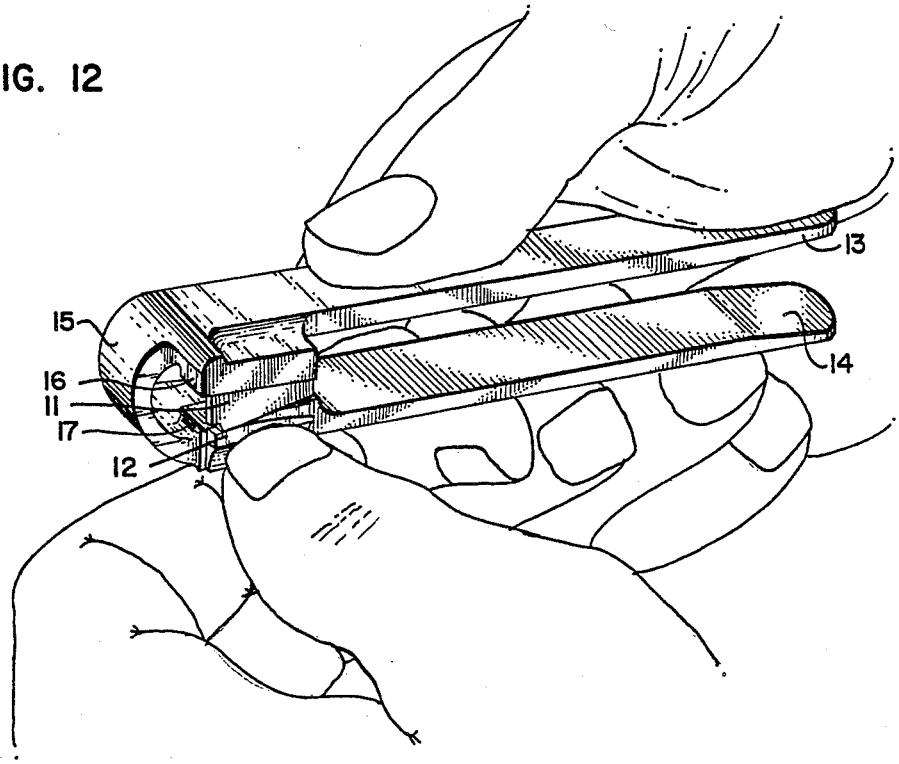
FIG. 12 is a perspective view of a fourth alternate embodiment of the present invention in use, in which the nail clipper device has lengthened handles.

The handles 13 and 14 of the present invention can also be lengthened in order to rest against the palm of the user and to thereby increase leverage, as shown in FIG. 12. This embodiment is particularly useful for people with arthritis and other hand-related problems.

Figure 13:
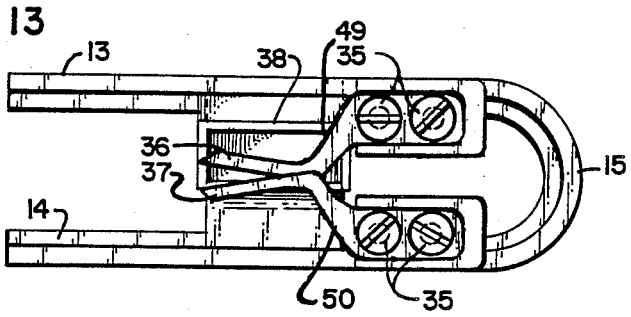
FIG. 13 is a side elevational view of a fifth alternate embodiment of the present invention having a different receptacle and configuration of blades.

The embodiment shown in FIG. 13 is a fifth alternate embodiment of the nail clipper. Upper and lower blades 36 and 37 are preferably made of metal, and they are aligned to have a scissors-like interference cut. The blades 36 and 37 extend from arms 49 and 50, which are connected to the upper 13 and lower 14 handles by suitable fasteners 35, such as screws. When the handles 13, 14 are not being compressed, the blades 36, 37 are angled slightly away from each other. A receptacle 38 is provided behind the blades 36 and 37 and between the handles 13 and 14. The receptacle 38 can be emptied through a hole (not shown) in either the upper 13 or lower 14 handle above or below the receptacle 38.

Figure 14:
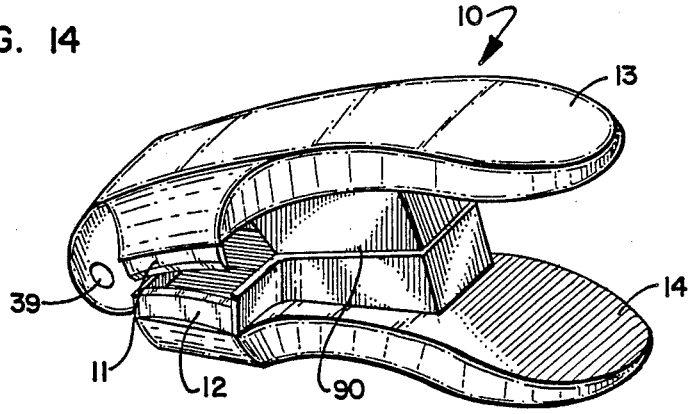
FIG. 14 is a perspective view of a sixth alternate embodiment of the present invention having a hinge.

A sixth alternate embodiment is shown in FIG. 14. Instead of an integral central arc portion 15, a hinge 39 is provided for movement of the upper 13 and lower handles 14. A receptacle 90 is located between the handles, and a spring (not shown) located proximate the hinge and between the handles maintains the handles in an open position when the nail clipper 10 is not in use. To empty the receptacle 90, the handles 13 and 14 are pulled apart to allow the nail clippings to be removed. The blades 11 and 12 are concave and provide a scissors-type interference cut. The handles of this embodiment are preferably made of metal or plastic, plastic being the most preferred material.

It is to be understood that numerous and varied modifications can be readily devised in accordance with the principles of the present invention by those skilled in the art without departing from the spirit and scope of the invention. Therefore, it is not desired to restrict the invention to the particular constructions illustrated and described, but to cover all modifications that may fall within the scope of the appended claims.

I claim:

1. A nail clipper, comprising:

(a) a U-shaped body having a front and back end, including upper and lower, spaced-apart longitudinal handles interconnected by a central arc portion integral with said handles and between said handles proximate said front end, said handles being resiliently biased by said central arc portion into a partially extending, normal resting position whereby said central arc portion serves as a hinge means; and (b) upper and lower blades, said blades facing each other and rigidly secured along a longitudinal edge of said upper and lower handles respectively, said blades being located closer to the front end of the nail clipper than to the back end.

2. A nail clipper according to claim 1, wherein said handles and said central arc portion are integrally formed by injection plastic molding.

3. A nail clipper according to claim 1, wherein said handles and said central arc portion are made of a plastic material.

4. A nail clipper according to claim 3, wherein said blades include a roughened end which is pressed into the plastic material to said handles to securedly attach said blades thereto.

5. A nail clipper according to claim 1, wherein said upper and lower blades are aligned to provide scissors-like interference when said handles are compressed.

6. A nail clipper according to claim 1 further comprising a receptacle having an opening disposed proximate said blades for receipt of nail clippings, said receptacle located between said upper and lower handles.

7. A nail clipper according to claim 1, further comprising a receptacle having an opening disposed proximate said blades for receipt of nail clippings, said receptacle attached to said lower handle and located beneath said lower blade.

8. A nail clipper according to claim 1, further comprising a receptacle having an opening disposed proximate said blades for receipt of nail clippings, said receptacle being positioned transversely through said lower handle.

9. A nail clipper according to claim 1, wherein said blades are provided on both longitudinal edges of said U-shaped body.

10. A nail clipper according to claim 1, further comprising a file surface affixed to said nail clipper.

11. A nail clipper according to claim 1, wherein the length of said handles is about two and one-fourth ($2\frac{1}{4}$) inches.

12. A nail clipper according to claim 1, wherein the length of said handles is greater than two and one-fourth ($2\frac{1}{4}$) inches so that said nail clipper rests against the palm of the user's hand to increase leverage.

13. A nail clipper comprising:

(a) a plastic U-shaped body having a front and back end, including upper and lower, spaced-apart longitudinal handles interconnected by a central arc portion integral with said handles and between said handles proximate said front end, said handles being resiliently biased by said central arc portion into a parallelelly extending, normal resting position whereby by said central arc portion serves as a hinging means;

(b) upper and lower metal blades, said blades facing each other and rigidly secured along a longitudinal edge of said upper and lower handles, respectively, said blades being located closer to the front end of the nail clipper than to the back end, said blades being aligned to provide a scissors-like interference when said handles are compressed; and (c) a receptacle having an opening disposed proximate said blades for receipt of nail clippings.

14. A nail clipper according to wherein said receptacle comprises:

(a) a transverse cavity within said lower handle having a first opening proximate said lower blade and a second opening on the opposite side of said handle; and (b) a pivotally connected cover which covers said second opening to said cavity so that nail clippings can be removed when said cover is moved away from said second opening.

15. A nail clipper according to claim 13, wherein said receptacle is integrally formed with to said lower handle and located beneath said lower blade, said, receptacle having an opening on one end for removal of the nail clippings.

16. A nail clipper according to claim 13, wherein said receptacle is positioned between said upper and lower handles and attached thereto, said receptacle being closed off on the top and bottom by said upper and lower handles, so that said nail clippings can be removed when said upper and lower handles are pulled apart.

17. A nail clipper according to claim 13, wherein said receptacle is positioned between said upper and lower handles and attached thereto, with an opening in one of said handles corresponding to said receptacle, from which the nail clippings can be removed.

18. A nail clipper according to claim 13, wherein said central arc portion includes hinging means.

19. A nail clipper according to claim 18, wherein said hinging means comprises a pin which is inserted into transverse aligned holes in said upper and lower handles.

20. A nail clipper according to claim 19, wherein said handles are made of metal.

21. A nail clipper according to claim 18, further comprising means for biasing which is interconnected to said upper and lower handles and located therebetween so as to maintain said handles in a substantially parallel position.

22. A nail clipper according to claim 21 wherein said means for biasing comprises a spring interconnected to and between said upper and lower handles and located proximate said central arc portion.

23. A nail clipper according to claim 13, wherein said handles and said central arc portion are integrally formed by injection plastic molding.

24. A nail clipper according to claim 13, further comprising a file surface affixed to said U-shaped body.

25. A nail clipper according to claim 13, wherein the length of said handles is about two and one-fourth ($2\frac{1}{4}$) inches.

26. A nail clipper according to claim 13, wherein the length of said upper and lower handles is greater than two and one-fourth ($2\frac{1}{4}$) inches so that said nail clipper rests against the palm of the user's hand to increase leverage.

27. A nail clipper according to claim 13, wherein said blades are provided on both longitudinal edges of said U-shaped piece.

28. A nail clipper according to claim 13, wherein said blades are made of plastic.

29. A nail clipper according to claim 13, wherein said blades are concave.

30. A nail clipper according to claim 13, further comprising a stop located between said upper and lower handles and integrally formed with one of said handles to limit movement of said handles when said handles are compressed.

31. A nail clipper according to claim 13, wherein said blades include a roughened end which is pressed into the plastic material of said handles to securedly attach said blades thereto.

32. A nail clipper, comprising:

(a) a plastic U-shaped body having a front and back end, including upper and lower spaced-apart longitudinal handles interconnected by an integral central arc portion between said handles proximate said front end, said lower handle having a transverse cavity therethrough for receipt of nail clippings;

(b) upper and lower metal concave blades, said blades facing each other and rigidly secured along a longitudinal edge of said upper and lower handles respectively, said blades being located closer to the front end of said nail clipper than to the back end, said blades being aligned to provide a scissors-like interference when said handles are compressed; and (c) a pivotally mounted cover located at the opposite end of said transverse cavity from said blades and attached to said lower handle, whereby the nail clippings are emptied when said cover is pivoted.

33. A nail clipper according to claim 32, further comprising a pair of upper and lower stops connected to said upper and lower handles and located therebetween, said stops being integrally formed with said upper and lower handles, whereby the movement of said handles is limited when said handles are compressed.

34. A nail clipper according to claim 32, further comprising a file surface affixed to said nail clipper.

35. A nail clipper according to claim 32, wherein said blades include a roughened end which is pressed into the plastic material of said handles to securedly attach said blades thereto.

36. A nail clipper, comprising:

(a) a pair of upper and lower spaced-apart, substantially parallel, longitudinal plastic handles connected by a central hinging means;

(b) two upper and two lower blades, said blades facing each other and rigidly secured along a longitudinal edge of said upper and lower handles respectively, each pair of blades being located on either side of said central hinging means, said blades being aligned to provide a scissors-like interference; and (c) a pair of springs positioned on either side of said central hinging means, said springs attached to said upper and lower handles and located therebetween to maintain said handles in a substantially parallel position when said handles are not being compressed.

37. A nail clipper, comprising:

(a) a U-shaped body having a front end and back end, including upper and lower, spaced-apart longitudinal handles interconnected by an integral central arc portion between said handles proximate said front end, said handles and said central arc portion of a plastic material; and (b) upper and lower blades, said blades facing each other and rigidly secured along a longitudinal edge of said upper and lower handles respectively, said blades being located closer to the front end of the nail clipper than to the back end, said blades including a roughened end which is pressed into said plastic material of said handles to securely attach said blades thereto.

38. A nail clipper comprising:

(a) a plastic U-shaped body having a front and back end, including upper and lower spaced-apart longitudinal handles interconnected by an integral center arc portion between said handle proximate said front end;

(b) upper and lower metal blades, said blades facing each other and rigidly secured along a longitudinal edge of said upper and lower handles, respectively, said blades being located closer to the front end of the nail clipper than to the back end, said blades being aligned to provide a scissors-like interference when said handles are compressed; and (c) a receptacle having an opening disposed proximate said blades for receipt of nail clippings, said receptacle comprising:

(i) a transverse cavity within said lower handle having a first opening proximate said lower blade and a second opening on the opposite side of said handle; and (ii) a pivotally connected cover which covers said second opening to said cavity so that nail clippings can be removed when said cover is moved from said second opening.

39. A nail clipper comprising:

(a) a plastic U-shaped body having a front and back end including upper and lower spaced-apart longitudinal handles interconnected by an integral central arc portion between said handles proximate said front end;

(b) upper and lower metal blades, said blades facing each other and rigidly secured along a longitudinal edge of said upper and lower handles, respectively, said blades being located closer to the front end of the nail clipper than to the back end, said blades being aligned to provide a scissors-like interference when said handles are compressed; and (c) a receptacle having an opening disposed proximate said blades for receipt of nail clippings, said receptacle integrally formed with said lower handle and located beneath said lower blade, said receptacle having an opening on one end for removal of the nail clippings.

40. A nail clipper, comprising:

(a) a plastic U-shaped body having a front end and a back end, including upper and lower spaced-apart longitudinal handles interconnected by an integral central arc portion between said handles proximate said front end;

(b) upper and lower metal blades, said blades facing each other and rigidly secured along a longitudinal edge of said upper and lower handles respectively, said blades being located closer to the front end of the nail clipper than to the back end, said blades being aligned to provide a scissors-like interference when said handles are compressed; and (c) a receptacle having an opening disposed proximate said blades for receipt of nail clippings, said receptacle positioned between said upper and lower handles and attached thereto, said receptacle being closed off on the top and bottom of said upper and lower handles, so that said nail clippings can be removed when said upper and lower handles are pulled apart.

41. A nail clipper, comprising:

(a) a plastic U-shaped body having a front and back end, including upper and lower spaced-apart longitudinal handles interconnected by an integral central arc portion between said handles proximate said front end;

(b) upper and lower metal blades, said blades facing each other and rigidly secured along a longitudinal edge of said upper and lower handles respectively, said blades being located closer to the front end of the nail clipper than to the back end, said blades being aligned to provide a scissors-like interference when said handles are compressed; and (c) a receptacle having an opening disposed proximate said blades for receipt of nail clippings, said receptacle positioned between said upper and lower handles and attached thereto, with an opening in one of said handles corresponding to said receptacle, from which the nail clippings can be removed.

42. A nail clipper, comprising:

(a) a plastic U-shaped body having a front and back end, including upper and lower spaced apart longitudinal handles interconnected by an integral central arc portion between said handles proximate said front end, said central arc portion including a hinging means;

(b) upper and lower middle blades, said blades facing each other and rigidly secured along a longitudinal edge of said upper and lower handles, respectively, said blades being located closer to the front end of the nail clipper, than to the back end, said blades being aligned to provide a scissors-like interference when said handles are compressed;

(c) a receptacle having an opening disposed proximate said blades for receipt of nail clippings; and (d) a means for biasing which is interconnected to said upper and lower handles and located therebetween so as to maintain said handles in a substantially parallel position.

43. A nail clipper, comprising:

(a) a plastic U-shaped body having a front and back end, including upper and lower spaced apart longitudinal handles interconnected by an integral central arc portion between said handles proximate said front end, said central arc portion including a hinging means;

(b) upper and lower middle blades, said blades facing each other and rigidly secured along a longitudinal edge of said upper and lower handles, respectively, said blades being located closer to the front end of the nail clipper, than to the back end, said blades being aligned to provide a scissors-like interference then said handles are compressed;

(c) a receptacle having an opening disposed proximate said blades for receipt of nail clippings; and (d) means for biasing which is interconnected to said upper and lower handles and located therebetween so as to maintain handles in substantially parallel position, said biasing means comprising a spring interconnected to and between said upper and lower handles and located proximate said central arc portion.

44. A nail clipper, comprising:

(a) a plastic U-shaped body having a front and back end, including upper and lower spaced apart longitudinal handles interconnected by an integral central arc portion between said handles proximate said front end;

(b) upper and lower middle blades, said blades facing each other and rigidly secured along a longitudinal edge of said upper and lower handles, respectively, said blades being located closer to the front end of the nail clipper, then to the back end, said blades being aligned to provide a scissors-like interference when said handles are compressed;

(c) a receptacle having an opening disposed proximate said blades for receipt of nail clippings; and (d) a stop located between said upper and lower handles and integrally formed with one of said handles to limit movement of said handles when said handles are compressed.

45. A nail clipper, comprising:

(a) plastic U-shaped body having a front and back end, including upper and lower spaced apart longitudinal handles interconnected by an integral central arc portion between said handles proximate said front end;

(b) upper and lower metal blades, said blades facing each other and rigidly secured along a longitudinal edge of said upper and lower handles, respectively, said blades being located closer to the front end of the nail clipper than to the back end, said blades being aligned to provide a scissors-like interference when said handles are compressed, said blades including a roughened end which is pressed into the plastic material of said handles to securely attached blades thereto.

* * * * *